US005093648A

United States Patent [19]

Kimura et al.

[11] Patent Number: 5,093,648

[45] Date of Patent: Mar. 3, 1992

[54] ROTATIONAL TYPE VARIABLE RESISTOR

[75] Inventors: Masahiro Kimura; Kenji Hayase; Yukihisa Oda; Toshiyuki Kobayashi; Takayoshi Tsuzuki, all of Aichi, Japan

[73] Assignee: Aisin Seiki K.K., Aichi, Japan

[21] Appl. No.: 501,894

[22] Filed: Mar. 30, 1990

[30] Foreign Application Priority Data

Mar. 31, 1989 [JP] Japan ..... 1-038853[U]

[51] Int. Cl.[5] ..... H01C 10/32

[52] U.S. Cl. ..... 338/162; 338/306

[58] Field of Search ..... 338/160-176, 338/306, 308, 309, 314

[56] References Cited

U.S. PATENT DOCUMENTS

| | | | |
|---|---|---|---|
| 3,750,081 | 7/1973 | Miller | 338/174 |
| 4,495,524 | 1/1985 | Kakuhashi et al. | 338/314 |
| 4,751,492 | 6/1988 | Tsuzuki et al. | 338/176 |
| 4,785,277 | 11/1988 | Yashiro et al. | 338/162 |
| 4,864,273 | 9/1989 | Tsuzuki et al. | 338/174 |
| 4,933,661 | 6/1990 | Oda et al. | 338/174 |

*Primary Examiner*—Marvin M. Lateef

*Attorney, Agent, or Firm*—Sughrue, Mion, Zinn Macpeak & Seas

[57] ABSTRACT

A rotational type variable resistor includes a base plate having an arcuate resistance element and an arcuate electrode formed on one surface thereof. A shaft adapted to be connected to the control member is rotatably mounted in the housing and carries a pair of brushes which are disposed in sliding engagement with the resistance member and the electrode. The resistance element is formed from a first resistance layer deposited on the base plate between a pair of copper foil electrodes. A silver paste is disposed between the copper foil electrodes and the opposite ends of the first resistance layer and a second resistance layer is formed which completely overlies the first resistance layer and the copper foil electrodes. The arcuate electrode includes a first layer of copper foil disposed on the surface of the substrate. A silver paste is coated on the upper surface of the copper foil and a third resistance layer is disposed on the surface of the silver paste, and a fourth resistance layer covers the third resistance layer. The resistivity of the first and third layers differs from the resistivity of the second and fourth layers.

4 Claims, 4 Drawing Sheets

ROTATIONAL TYPE VARIABLE RESISTOR

BACKGROUND OF THE INVENTION

1. Field Of The Invention

The present invention relates to a rotational type variable resistor having a plurality of resistor lamination layers and in particular to a resistor of the type wherein a brush slides over the surface of the resistor lamination layers to produce a linear change in resistivity.

2. Description Of Related Art

An apparatus for a variable resistor of this type is disclosed in Japanese Kokai publication No. 63-182509. FIGS. 6, 7 and 8 of the present application show the variable resistor of this publication. The above-mentioned variable resistor has a base plate 50. A first lead portion 51, second lead portion 52 and an electrode 53 are defined on the surface of the base plate. The first and second lead portions 51, 52 and the electrode 53 made of copper foil are formed through an etching process. As shown in FIG. 7, an arc shaped first resistance layer 54, which is shown as a shaded portion, is laminated between the first lead portion 51 and the second lead portion 52. The first resistance element layer 54 is directly formed on the base plate 50. Likewise, a first resistance element layer 54' which is shown as a shaded portion is laminated on the surface of the electrode 53. The raw material of the first resistance layers 54,54 is a heat fusible carbon paste The electrical resistance of the first resistance layer 54 is 350 ohms per square cm of substrate. As shown in FIG. 8, a second resistance element layer 55 (double shaded portion) is laminated only on the surface of the first resistance layer 54. The raw material of the second resistance layer 55 is a heat fusible carbon paste. The electrical resistance of the second resistance element layer 55 is 3K ohms per square cm of substrate.

SUMMARY OF THE INVENTION

An object of the present invention is to provide a friction-proof variable resistor having very smooth sliding characteristics.

The object of the present invention is achieved by providing a variable resistor comprising, a base plate, an arc shaped first resistance layer formed on a surface of the base plate, and a second resistance layer formed on the first resistance layer to form a resistance portion, an arc shaped copper foil formed on the surface of the base plate, a silver paste disposed on the copper foil, a third resistance layer disposed on the silver paste and a fourth resistance layer disposed on the third resistance layer on the silver paste to form an electrode.

Other objects, advantages and novel features of the present invention will become apparent from the following detailed description of the invention when considered in conjunction with the accompanying drawings.

DETAILED DESCRIPTION OF THE INVENTION

Figure 1:
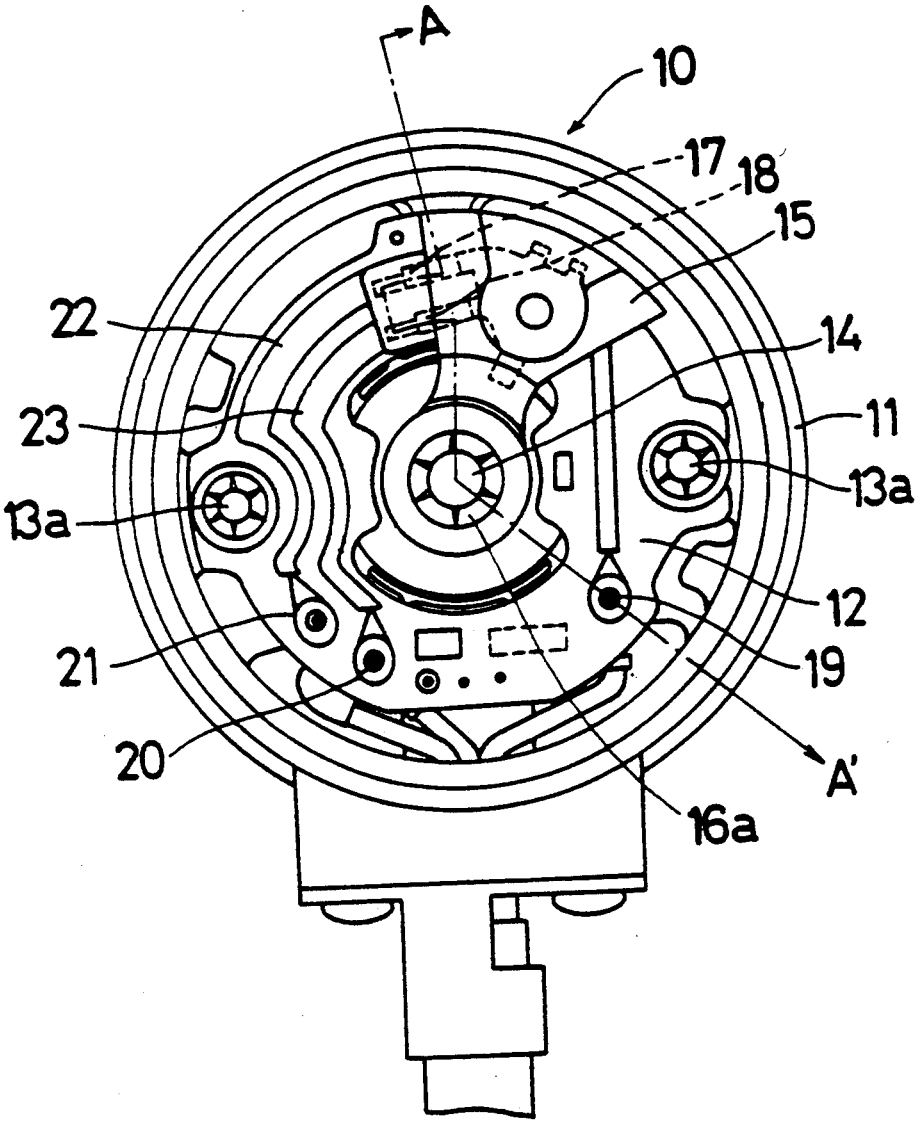
FIG. 1 is a front view of a rotational type variable resistor.
Figure 2:
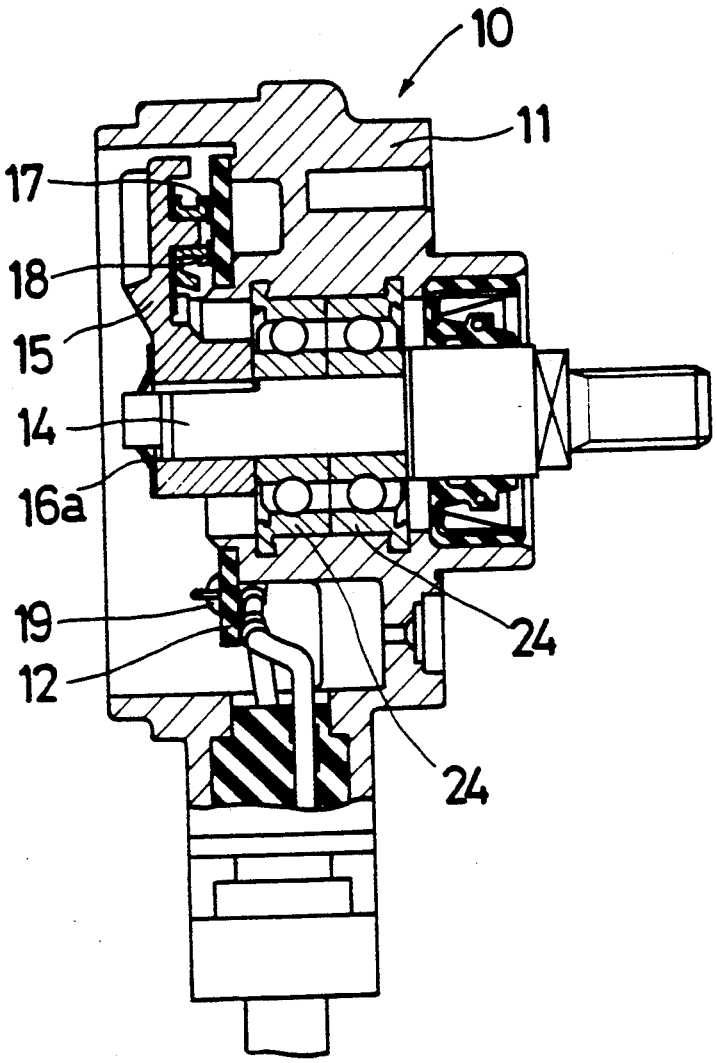
FIG. 2 is a sectional view of the rotational type variable resistor taken along line A—A' in FIG. 1.

FIGS. 1 and 2 show a rotational type variable resistor 10. A round shaped housing 11 includes a base plate 12. The base plate 12 is fixed to the housing by bolts 13*a*. A shaft 14 is rotatably connected to the housing 11. A rotational plate 15 is fixed to the shaft 14 by a retainer 16*a*. Brushes 17 and 18 are supported on the rotational plate 15. The brushes 17 and 18 are disposed in sliding contact with the base plate 12. A plurality of terminals 19, 20 and 21 are defined on the base plate 12. The terminal 19 connects with a power source, the terminal 20 connects with a ground wire and the terminal 21 connects with an output line. The shaft 14, for example, is coupled to a throttle valve (not shown) and rotates in accordance with the opening ratio of the throttle valve. A resistance portion 22 and electrode 23 are formed on the surface of the base plate 12. The brush 17 slidably contacts the resistance portion 22, and the brush 18 slidably contacts the electrode 23. A contact point is defined in accordance with the location of the rotational plate 15. FIG. 2 shows a sectional view of the variable resistor taken along line A—A' in FIG. 1. Bearings 24 are arranged between the housing 11 and the shaft 14.

Figure 3:
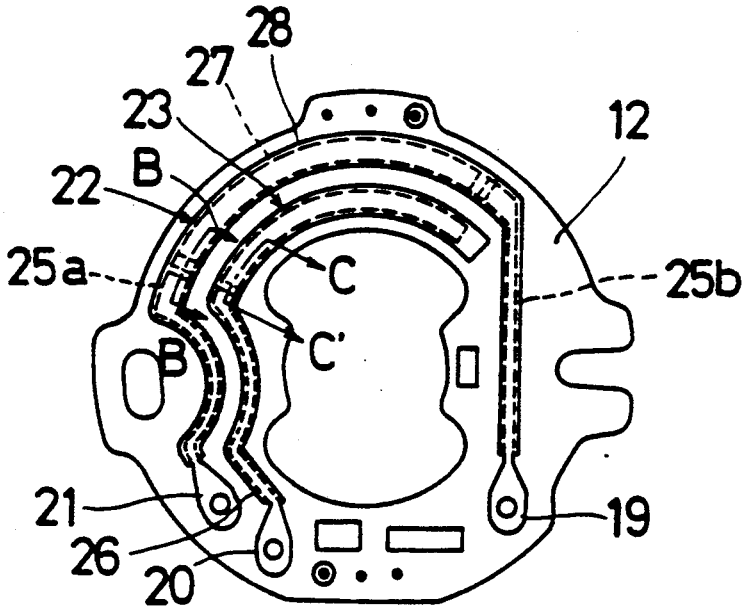
FIG. 3 is a front view of the base plate according to the present invention.
Figure 4:
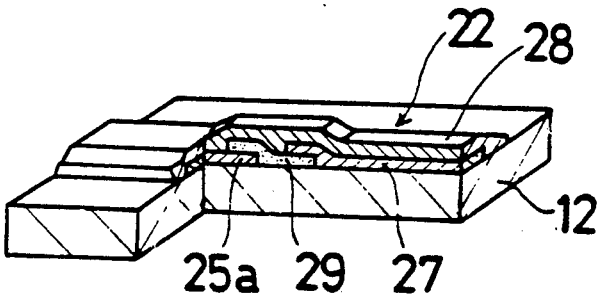
FIG. 4 is a sectional view of the rotational type variable resistor taken along line B—B' in FIG. 3.

FIG. 3 is a front view of the base plate 12 and shows copper foil electrodes 25*a*, 25*b* and 26 formed on the base plate 12 in electrical contact with terminals 21, 19 and 20 respectively. The copper foil electrodes 25*a*, 25*b* and 26 are produced by an etching process. As best seen in FIG. 4, which is a partial cross-sectional view taken along the line B—B' in FIG. 3, a silver paste 29 is coated on a portion of the base plate 12 and over the end portion of the electrode 25*a*. A similar coating of silver paste is provided at the end of the electrode 25*b*. An arc shaped first resistance layer is formed on the base layer 12 with the ends thereof overlapping the silver paste 29 adjacent the electrodes 25*a* and 25*b*. A second resistance layer 28 is then formed over the first resistance layer 27, the exposed portions of the silver paste 29 and the electrode 25*a* and the electrode 25*b*. The silver paste 29 prohibits the oxidation of the edge portion of the copper foil electrodes 25*a* and 25*b* and provides an electrical connection between the copper foil electrodes 25*a* and 25*b* with opposite ends of the resistance layer 27. The second resistance layer 28 provides a smooth unbroken outer surface which is engageable by the brush 17.

Figure 5:
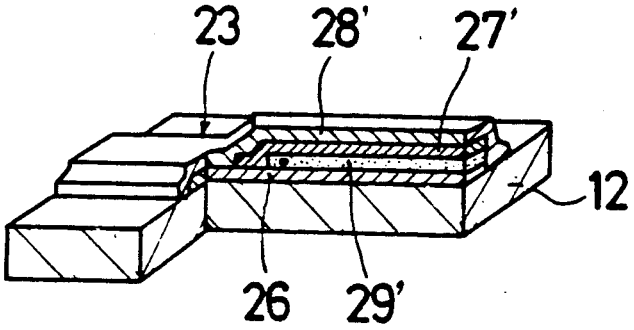
FIG. 5 is a sectional view of the rotational type variable resistor taken along line C—C' in FIG. 3.
Figure 6:
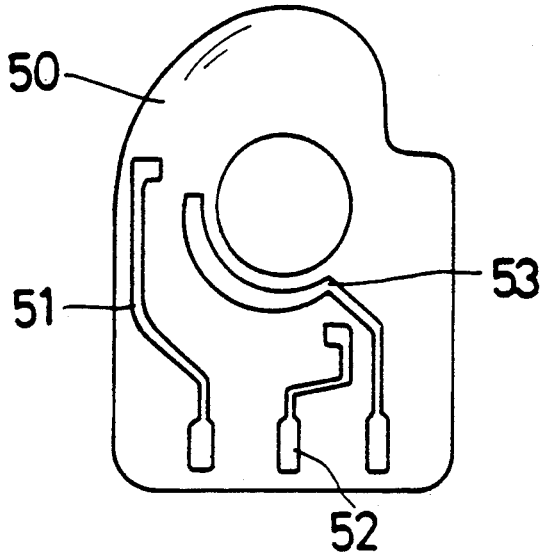
Fig. 6 PRIOR ART
FIG. 6, 7 and 8 are front views of the base plate of the related art showing the sequence of formation of the resistor.
Figure 7:
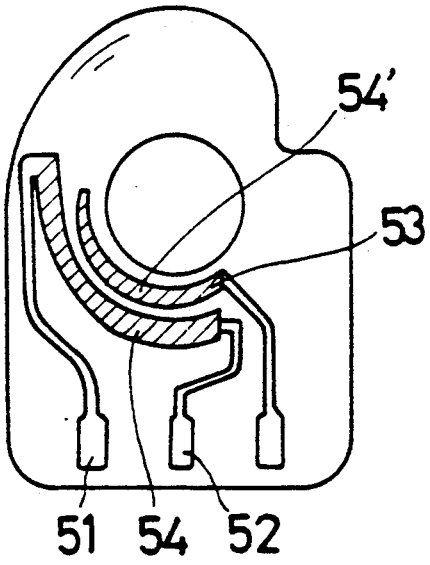
Fig. 7 PRIOR ART
Figure 8:
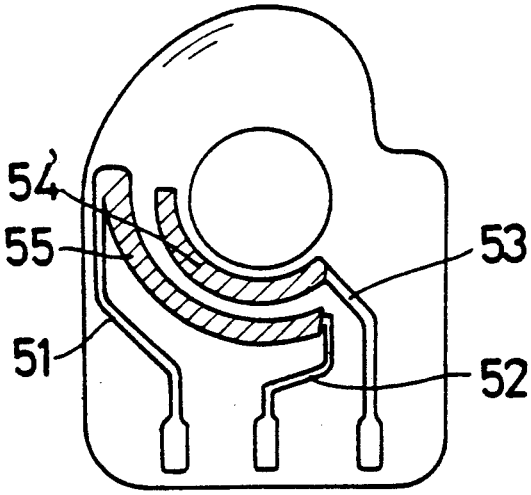
Fig. 8 PRIOR ART

FIG. 5 is a cross-sectional view of the resistance portion 23 taken along the line C—C' in FIG. 3. A silver paste 29' is coated on the arc shaped portion of the copper foil electrode 26 as viewed in FIG. 3. A third resistance layer 27' is formed on the silver paste coating 29' with the end portions of the layer 27' contacting the copper foil electrode 26. A fourth resistance layer 28' completely covers the first resistance layer 27' and the copper foil electrode 26 with the completed assembly defining electrode 23 and providing a surface upon which the brush 18 is slidable.

The material of the first and third resistance layers 27, 27' has a resistivity of 350 ohms per square centimeter and the material of the second and fourth resistance layers 28, 28' has a resistivity of 3K ohms per square centimeter. Comparing the carbon content between the first and third resistance layers 27, 27' and the second and fourth resistance layers 28, 28' the raw material of the first and third resistance layers has a higher carbon content.

What is claimed is:

1. A rotational type variable resistor comprising:

a base plate having an arc shaped resistance portion and an arc shaped electrode formed thereon adapted to be slidably engaged by rotatable brush means:

said resistance portion being comprised of a first arc shaped resistance layer formed on a surface of said base plate and a second resistance layer formed on said first resistance layer: and said electrode being comprised of an arc shaped copper foil formed on said surface of said base plate, a silver paste disposed on said copper foil, a third resistance layer disposed on said silver paste and a fourth resistance layer disposed on said first resistance layer.

2. A rotational type variable resistor as set forth in claim 1 further comprising additional electrodes of copper foil formed on said surface of said base plate adjacent opposite ends of said arc shaped resistance portion and a silver paste disposed between said additional electrodes and said arc shaped first resistance layer of said resistance portion.

3. A rotational type variable resistor as set forth in claim 1 wherein said arc shaped copper foil and said additional electrodes of copper foil are formed by an etching process.

4. A rotational type variable resistor as set forth in claim 1, wherein said first and third resistance layers has a resistivity of 350 ohms per square centimeter and the material of said second and fourth resistance layers has a resistivity of 3K ohms per square centimeter.

* * * * *